US009048531B2

(12) United States Patent
Nozawa

(10) Patent No.: US 9,048,531 B2
(45) Date of Patent: Jun. 2, 2015

(54) INFORMATION COMMUNICATION DEVICE AND ANTENNA

(75) Inventor: Tetsufumi Nozawa, Tokyo (JP)

(73) Assignees: SONY CORPORATION, Tokyo (JP); SONY COMPUTER ENTERTAINMENT INC., Tokyo (JP)

( * ) Notice: Subject to any disclaimer, the term of this patent is extended or adjusted under 35 U.S.C. 154(b) by 126 days.

(21) Appl. No.: 12/752,329

(22) Filed: Apr. 1, 2010

(65) Prior Publication Data

US 2010/0253582 A1 Oct. 7, 2010

(30) Foreign Application Priority Data

Apr. 2, 2009 (JP) ..... 2009-090573

(51) Int. Cl.

| | |
|---|---|
| ***H01Q 1/24*** | (2006.01) |
| ***H01Q 9/04*** | (2006.01) |
| ***H01Q 1/22*** | (2006.01) |
| ***H01Q 13/10*** | (2006.01) |

(52) U.S. Cl.

CPC ..... *H01Q 1/2266* (2013.01); *H01Q 1/243* (2013.01); *H01Q 9/0421* (2013.01); *H01Q 13/10* (2013.01)

(58) Field of Classification Search

USPC ..... 343/702, 700 MS, 904–906, 872, 846
See application file for complete search history.

(56) References Cited

U.S. PATENT DOCUMENTS

| | | | | |
|---|---|---|---|---|
| 6,049,314 | A * | 4/2000 | Munson et al. | 343/846 |
| 6,246,368 | B1 * | 6/2001 | Deming et al. | 343/700 MS |
| 6,326,919 | B1 * | 12/2001 | Diximus et al. | 343/700 MS |
| 6,342,860 | B1 * | 1/2002 | Haussler et al. | 343/702 |
| 6,384,794 | B1 * | 5/2002 | Huang | 343/767 |
| 6,414,642 | B2 * | 7/2002 | Honda et al. | 343/702 |
| 7,538,733 | B2 | 5/2009 | Isogai | |
| 2004/0090375 | A1 * | 5/2004 | Dai et al. | 343/700 MS |
| 2004/0090376 | A1 * | 5/2004 | Dai et al. | 343/700 MS |
| 2009/0021430 | A1 | 1/2009 | Isogai | |

FOREIGN PATENT DOCUMENTS

| | | |
|---|---|---|
| CN | 1331853 | 1/2002 |
| FR | 2 778 499 | 11/1999 |
| FR | 2 791 815 | 10/2000 |
| JP | 2002-223114 | 8/2002 |
| JP | 2002-353726 | 12/2002 |
| JP | 2006-121190 | 5/2006 |
| WO | 00/30211 | 5/2000 |
| WO | 2004/097980 | 11/2004 |

OTHER PUBLICATIONS

European Search Report dated Jul. 8, 2010, from the corresponding European Application.
Chinese Office Action dated Oct. 10, 2012, from corresponding Chinese Application No. 201010149677.3.
Japanese Notification of Reasons for Refusal dated Apr. 1, 2014 from corresponding Application No. 2010-021645.

* cited by examiner

*Primary Examiner* — Robert Karacsony
*Assistant Examiner* — Amal Patel
(74) *Attorney, Agent, or Firm* — Katten Muchin Rosenman LLP

(57) ABSTRACT

Provided is an information communication device, including an enclosure, and an antenna disposed in the enclosure so that at least one surface of a radiation plate is oblique with respect to a bottom surface of the enclosure, the antenna having a feeding point located on the surface that is oblique with respect to the bottom surface.

4 Claims, 11 Drawing Sheets

INFORMATION COMMUNICATION DEVICE AND ANTENNA

BACKGROUND OF THE INVENTION

1. Field of the Invention

The present invention relates to an information communication device and an antenna for transmitting/receiving information by means of a radio signal.

2. Description of the Related Art

There is known an information communication device that performs wireless communications based on the Bluetooth standard, the IEEE 802.11 standard, and the like. Such an information communication device may be required to transmit/receive, with at least a given strength, polarized waves having various orientations. For example, in a case where the information communication device is a home-use game machine, there is a need to perform wireless communications with various types of peripheral devices which are configured to transmit/receive differently-oriented main polarized waves, such as a controller for the game machine, in which an antenna is disposed in a horizontal direction, and a headset in which an antenna is disposed in a vertical direction. In view of this, as one example of such an information communication device, there is proposed an information communication device that transmits/receives a radio signal through a polarization diversity system (for example, see US 2009/0021430). The information communication device that employs the polarization diversity system is equipped with two antennas that cover a vertically polarized wave and a horizontally polarized wave, respectively. With this configuration, the information communication device is capable of transmitting/receiving both the vertically polarized wave and the horizontally polarized wave with sufficient strengths.

SUMMARY OF THE INVENTION

An object of the present invention is to provide an information communication device and an antenna, which are capable of transmitting/receiving both a vertically polarized wave and a horizontally polarized wave with sufficient strengths using only a single antenna.

According to the present invention, there is provided an information communication device for performing wireless communication, including an enclosure, and an antenna disposed in the enclosure so that at least one surface of a radiation plate is oblique with respect to a bottom surface of the enclosure, the antenna having a feeding point located on the surface that is oblique with respect to the bottom surface.

In the above-mentioned information communication device, the radiation plate may include, on the surface that is oblique with respect to the bottom surface, a portion extending from the feeding point in a direction parallel to the bottom surface.

Further, the antenna may be fed with power through a coaxial cable. The portion of the radiation plate, which extends in the direction parallel to the bottom surface, may be connected to an inner conductor of the coaxial cable. The radiation plate may further include, on the surface that is oblique with respect to the bottom surface, a portion that is connected to an outer conductor of the coaxial cable and extends in a direction perpendicular to the bottom surface.

Further, in the above-mentioned information communication device, the enclosure may be configured so as to be placed with one of side surfaces of the enclosure, which intersect the bottom surface, being used as a downward surface that faces a floor surface as well as the bottom surface, and the antenna may be disposed in the enclosure so that the surface that is oblique with respect to the bottom surface is also oblique with respect to the one of the side surfaces.

Further, in the above-mentioned information communication device, the radiation plate may include a portion that constitutes a surface parallel to the bottom surface, and is jointed to a portion constituting the surface that is oblique with respect to the bottom surface.

Further, according to the present invention, there is provided an antenna including, in at least part of a radiation plate, a surface formed so as to be oblique with respect to a horizontal surface, and another surface connected to the surface that is oblique with respect to the horizontal surface so as to form an obtuse angle with respect to the surface that is oblique with respect to the horizontal surface, in which the surface that is oblique with respect to the horizontal surface has a feeding point located thereon.

Further, in the above-mentioned antenna, the radiation plate may include, on the surface that is oblique with respect to the horizontal surface, a portion extending from the feeding point in a direction parallel to the horizontal surface.

Further, the above-mentioned antenna may be fed with power through a coaxial cable. The portion of the radiation plate, which extends in the direction parallel to the horizontal surface, may be connected to an inner conductor of the coaxial cable. The radiation plate may further include, on the surface that is oblique with respect to the horizontal surface, a portion that is connected to an outer conductor of the coaxial cable and extends in a direction perpendicular to the horizontal surface.

DETAILED DESCRIPTION OF THE INVENTION

Hereinafter, an embodiment of the present invention is described with reference to the attached drawings.

Figure 1A:
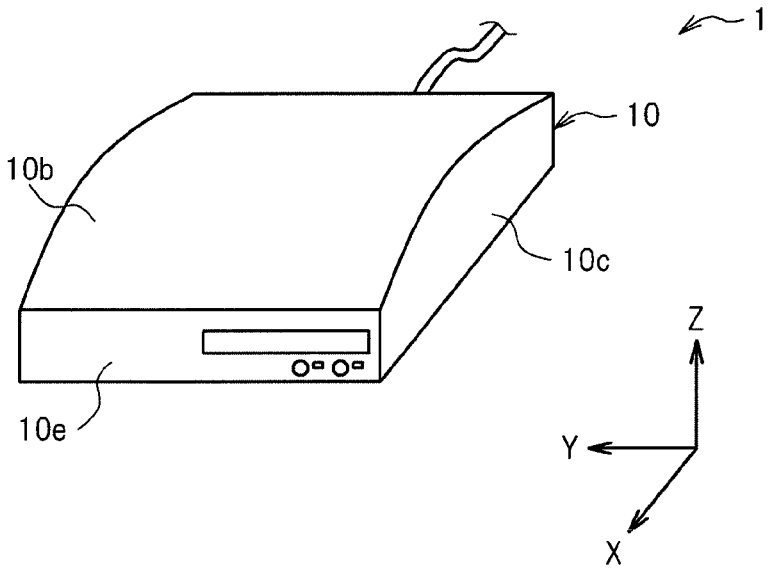
FIG. 1A is an explanatory diagram illustrating an outer appearance of an information communication device according to an embodiment of the present invention.
Figure 1B:
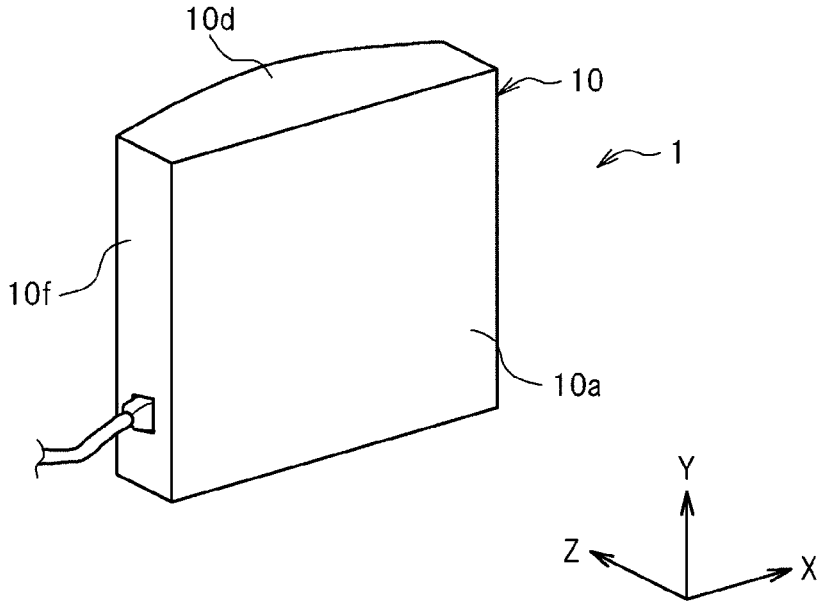
FIG. 1B is an explanatory diagram illustrating an outer appearance of the information communication device according to the embodiment of the present invention.
Figure 1C:
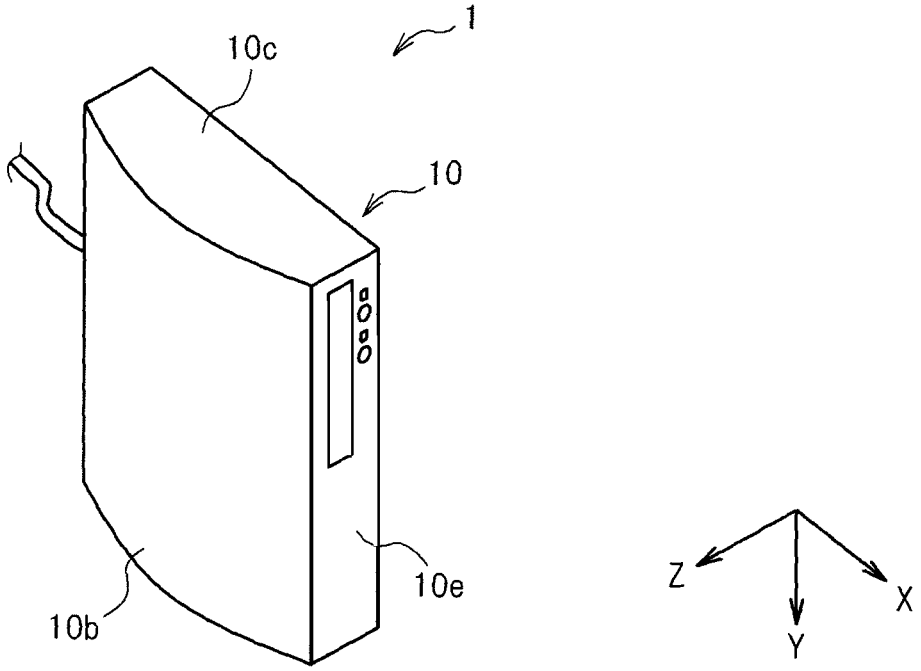
FIG. 1C is an explanatory diagram illustrating an outer appearance of the information communication device according to the embodiment of the present invention.

An information communication device 1 according to the embodiment of the present invention is, for example, a home-use game machine or a personal computer. As illustrated in FIGS. 1A, 1B, and 1C, the information communication device 1 includes an enclosure 10 having a thin box shape, and transmits/receives information to/from an external device, such as a peripheral device, through wireless communications. Note that in this embodiment, the information communication device 1 is compliant with both the wireless communication based on the Bluetooth standard and the wireless communication based on the IEEE 802.11 standard.

The enclosure 10 generally has six outer surfaces. Hereinafter, of those outer surfaces, one of the two surfaces that have the largest area is referred to as a first bottom surface 10*a*, whereas the other surface that is opposed to the first bottom surface 10*a* is referred to as a first top surface 10*b*. The other four outer surfaces are side surfaces that intersect both the first bottom surface 10*a* and the first top surface 10*b*. Hereinafter, one of those side surfaces is referred to as a second bottom surface 10*c*. Further, a surface that is opposed to the second bottom surface 10*c* is referred to as a second top surface 10*d*. One of the two remaining outer surfaces is referred to as a front surface 10*e*, whereas the other one is referred to as a rear surface 10*f*. Further, hereinafter, as illustrated in FIGS. 1A, 1B, and 1C, a direction that extends parallel to the first bottom surface 10*a* from the rear surface 10*f* to the front surface 10*e* is set as an X-axis positive direction, a direction that extends parallel to the first bottom surface 10*a* from the second bottom surface 10*c* to the second top surface 10*d* is set as a Y-axis positive direction, and a direction that extends parallel to the second bottom surface 10*c* (perpendicularly to the first bottom surface 10*a*) from the first bottom surface 10*a* to the first top surface 10*b* is set as a Z-axis positive direction. In other words, the first bottom surface 10*a* is a surface parallel to an X-Y plane, whereas the second bottom surface 10*c* and the second top surface 10*d* are surfaces parallel to a Z-X plane.

The enclosure 10 of the information communication device 1 is configured so as to be placed with any one of the first bottom surface 10*a* and the second bottom surface 10*c* being used as a bottom surface (surface that faces a floor surface). Specifically, as illustrated in FIG. 1A, the enclosure 10 may be placed with the first bottom surface 10*a* facing downward (horizontal placement). Alternatively, as illustrated in FIG. 1B, the enclosure 10 may also be placed for use with the second bottom surface 10*c* facing downward (vertical placement). Note that, in a case where the enclosure 10 is placed with the second bottom surface 10*c*, which is smaller in area compared to the first bottom surface 10*a*, facing downward, the enclosure 10 may be placed by being supported by a support stand, instead of being placed directly on the floor surface. Further, the enclosure 10 may be placed so that instead of the second bottom surface 10*c*, the second top surface 10*d* that is opposed to the second bottom surface 10*c* becomes the bottom surface. In this case, as illustrated in FIG. 1C, the second bottom surface 10*c* faces upward, and the enclosure 10 is placed upside down from the case of FIG. 1B.

Further, the information communication device 1 is normally placed so that the front surface 10*e* faces toward the direction of a user of the information communication device 1. Accordingly, the front surface 10*e* may be provided with an indicator for showing an operation status of the device to the user, and switches or the like which are used relatively often by the user. Further, the rear surface 10*f* may be provided with connectors to which various types of cables, such as a power cable, are connected. In this manner, a presentation section for presenting various types of information to the user, an operation section for receiving operations from the user, and the connectors and the like are provided on outer surfaces other than the first bottom surface 10*a*, the second bottom surface 10*c*, and the second top surface 10*d*. As a result, even if the enclosure 10 is placed with any one of the first bottom surface 10*a*, the second bottom surface 10*c*, and the second top surface 10*d* facing downward, the information communication device 1 may be used.

Figure 2:
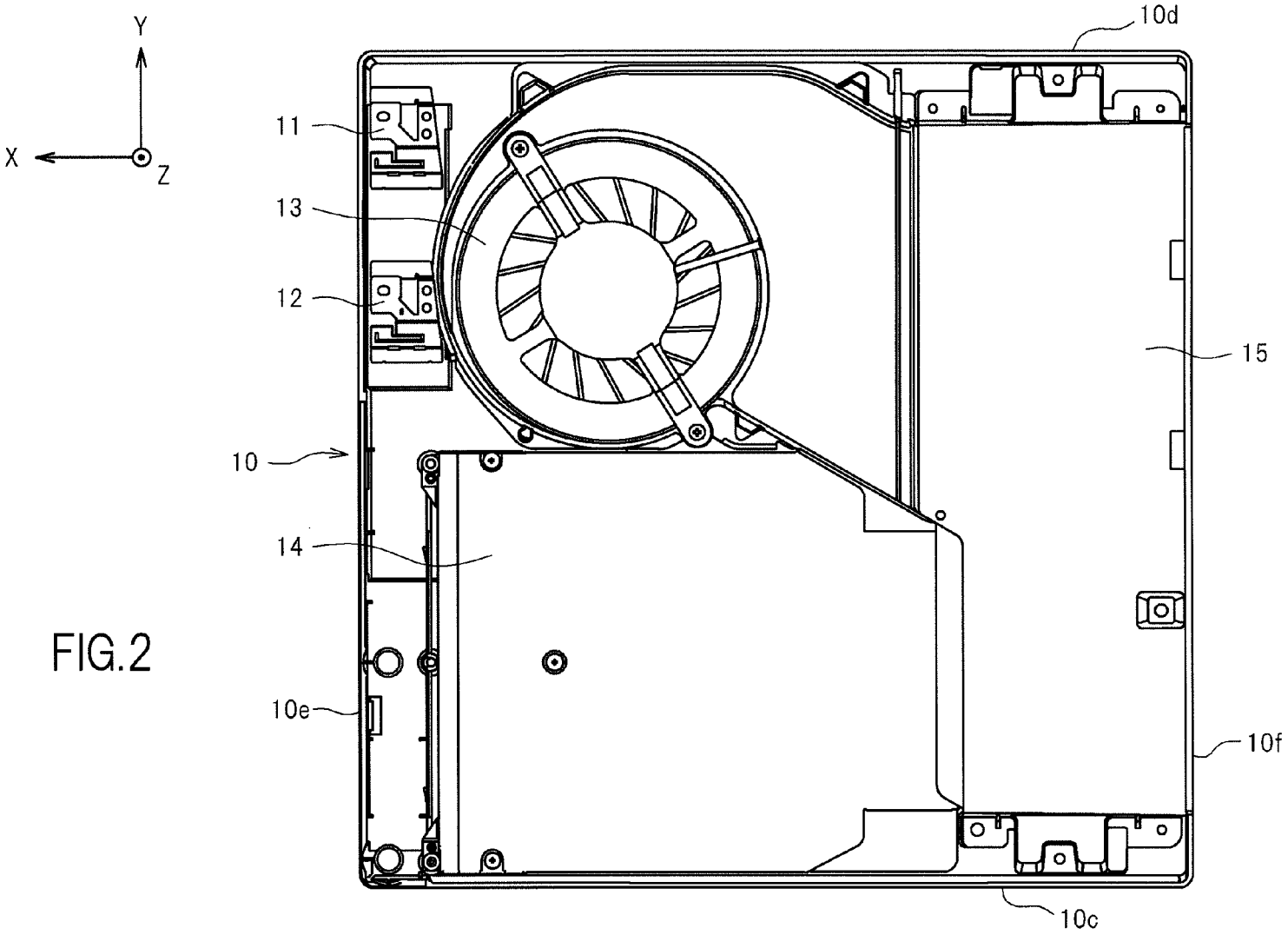
FIG. 2 is a plan view illustrating an inner state of an enclosure of the information communication device according to the embodiment of the present invention.

FIG. 2 is a plan view illustrating an inner state of the enclosure 10. As illustrated in FIG. 2, within the enclosure 10, there are disposed a first antenna 11, a second antenna 12, a cooling fan 13, an optical disk drive 14, and a power supply unit 15. Here, the first antenna 11 is an antenna used for the wireless communication based on the Bluetooth standard, and the second antenna 12 is an antenna used for the wireless communication based on the IEEE 802.11 standard. As illustrated in FIG. 2, the first antenna 11 and the second antenna 12 are disposed in the vicinity of the front surface 10*e* of the enclosure 10 (that is, on a side closer to the front surface 10*e* than such structures as the cooling fan 13 and the power supply unit 15). With this configuration, radio signals radiated toward the front surface 10*e* from the first antenna 11 and the second antenna 12 travel toward the direction in which the user may conceivably exist without interference of the cooling fan 13 and the like. Further, at least part of the radio signal radiated to the rear surface 10*f* side is reflected by the cooling fan 13 and the like, and accordingly, travels toward the front surface 10*e* side as well.

Figure 3:
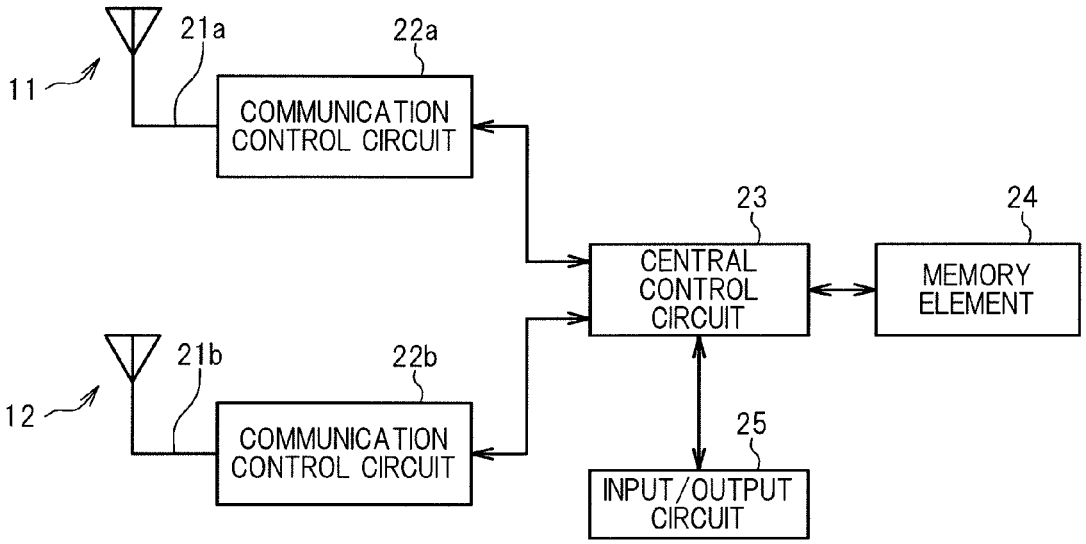
FIG. 3 is a configuration block diagram illustrating a schematic configuration of a circuit to be implemented in the information communication device according to the embodiment of the present invention.

FIG. 3 is a configuration block diagram illustrating a schematic configuration of a circuit to be implemented in the information communication device 1 according to this embodiment. As illustrated in FIG. 3, the first antenna 11 is connected to a communication control circuit 22*a* via a feeder 21*a*. Similarly, the second antenna 12 is connected to a communication control circuit 22*b* via a feeder 21*b*. Further, both the communication control circuits 22*a* and 22*b* are connected to a central control circuit 23. The central control circuit 23 is further connected to a memory element 24 and an input/output circuit 25.

The communication control circuits 22*a* and 22*b* perform signal processing according to the respective wireless communication standards to control the wireless communications. Specifically, the communication control circuits 22*a* and 22*b* feed power to the first antenna 11 and the second antenna 12 corresponding thereto via the feeders 21*a* and 21*b*, respectively. Then, when the communication control circuits 22*a* and 22*b* have received, from the central control circuit 23, an input of information to be transmitted, the communication control circuits 22*a* and 22*b* modulate the information, to thereby obtain modulated signals. The communication control circuits 22*a* and 22*b* supply the modulated signals to the respective antennas, and then cause the respective antennas to radiate the modulated signals by wireless. Further, the communication control circuits 22*a* and 22*b* receive signals that have reached the respective antennas, and then demodulate the received signals. The resultants are output to the central control circuit 23.

The central control circuit 23 is a program control device such as a CPU. The central control circuit 23 operates according to programs stored in the memory element 24. When a program stored in the memory element 24 has given the central control circuit 23 an instruction to transmit information to an external device connected through wireless communication, the central control circuit 23 outputs, to the communication control circuit 22*a* or 22*b*, the information to be transmitted. Further, the central control circuit 23 receives inputs of information received by the communication control circuits 22*a* and 22*b*, and performs processing using the information.

The memory element 24 includes a random access memory (RAM), a read only memory (ROM), and the like. The memory element 24 stores programs copied from a recording medium or the like (not shown). Further, the memory element 24 operates as a working memory for holding information to be used for processing by the central control circuit 23.

The input/output circuit 25 is connected to the central control circuit 23, a display, which is an external input/output device (including a home-use television set and the like), and the like. The input/output circuit 25 outputs a video signal to the display or the like according to an instruction input from the central control circuit 23.

In the information communication device 1 according to this embodiment, for example, the central control circuit 23 executes a program, such as a game program. Then, from a game controller, which is an external device, information that indicates the content of an operation made by the user is received through the wireless communication based on the Bluetooth standard. Further, an audio signal is transmitted to an audio reproducing device, such as a headset or head phones, through the wireless communication based on the Bluetooth standard. Further, the information communication device 1 exchanges information with another information communication device through the wireless communication based on the IEEE 802.11 standard.

The game controller generally has a horizontally long shape to provide better operability in a state in which the user is holding the game controller with their two hands. Accordingly, an antenna built into the game controller is disposed in a direction horizontal to the ground, and hence a radio signal to be transmitted/received is a horizontally polarized wave. On the other hand, in the case of the headset or the like, an antenna is disposed in a direction perpendicular to the ground, and hence a radio signal to be transmitted/received is a vertically polarized wave. In this embodiment, the shapes of the first antenna 11 and the second antenna 12 and the layout thereof in the enclosure 10 are determined so that the radio signals polarized in various orientations as described above are transmitted/received with a sufficient strength. Note that the Bluetooth standard and the IEEE 802.11 standard use the same frequency band, that is, the 2.4 GHz band. Accordingly, the first antenna 11 and the second antenna 12 have substantially the same shape. In view of this, hereinafter, taking the first antenna 11 as an example, the shape thereof is described in details.

Figure 4:
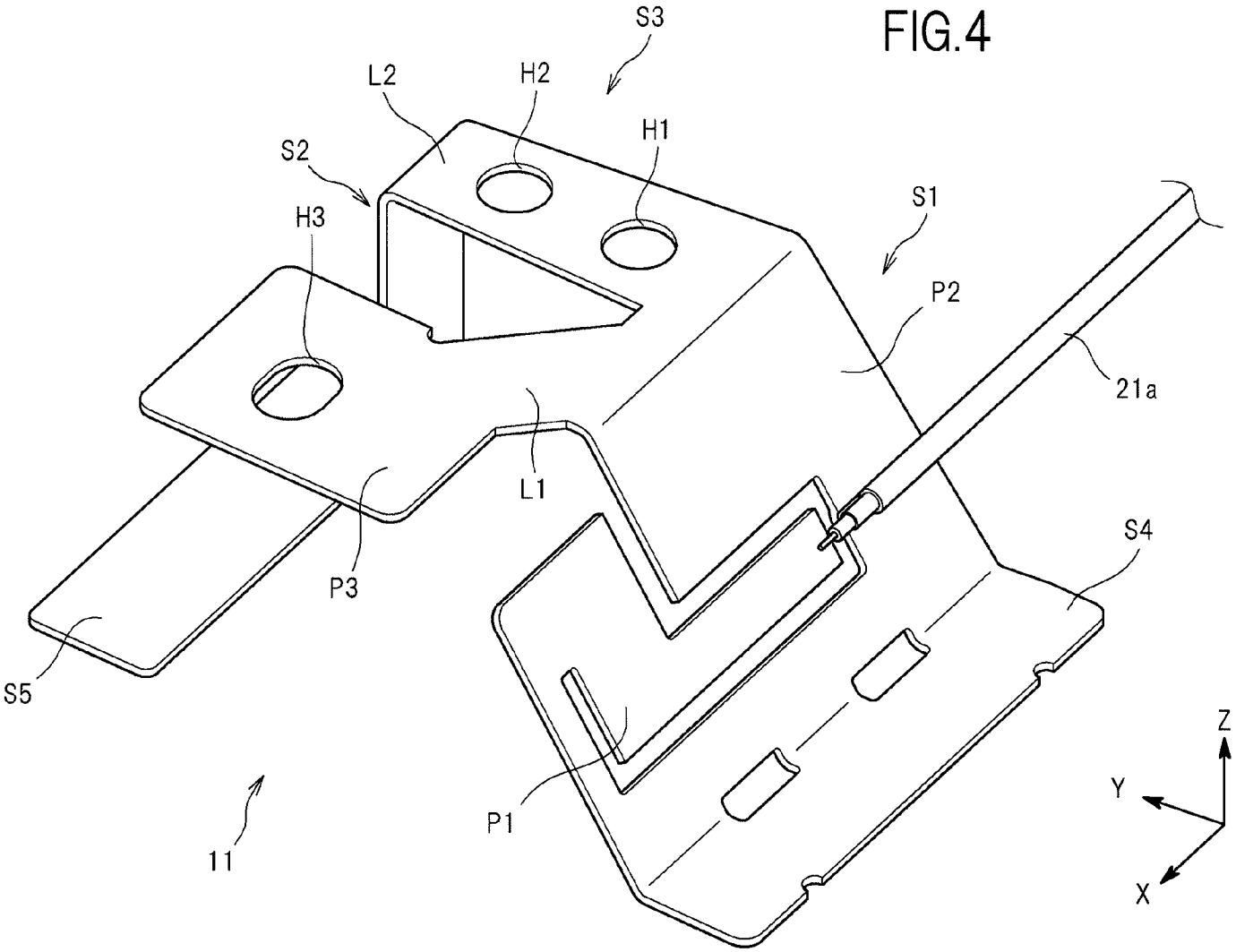
FIG. 4 is a perspective view illustrating a general view of an antenna of the information communication device according to the embodiment of the present invention.
Figure 5:
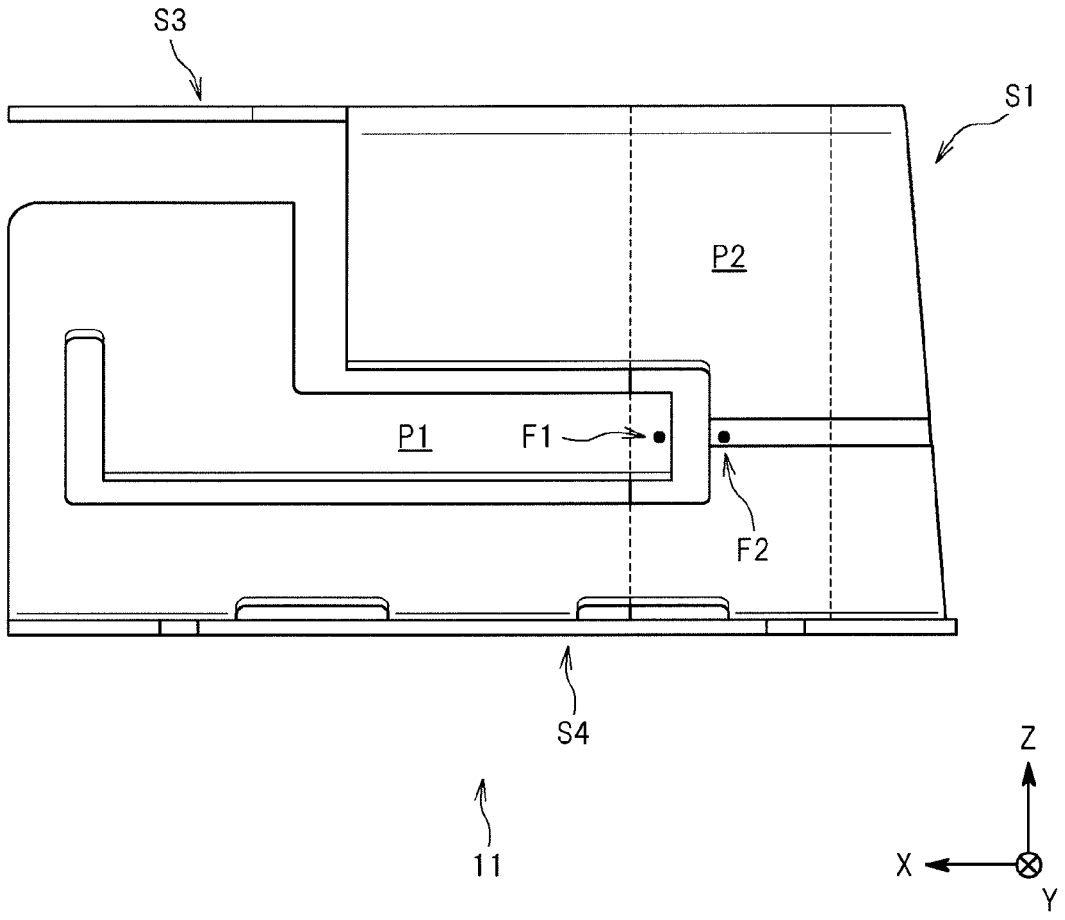
FIG. 5 is a front view illustrating a general view of the antenna of the information communication device according to the embodiment of the present invention.
Figure 6:
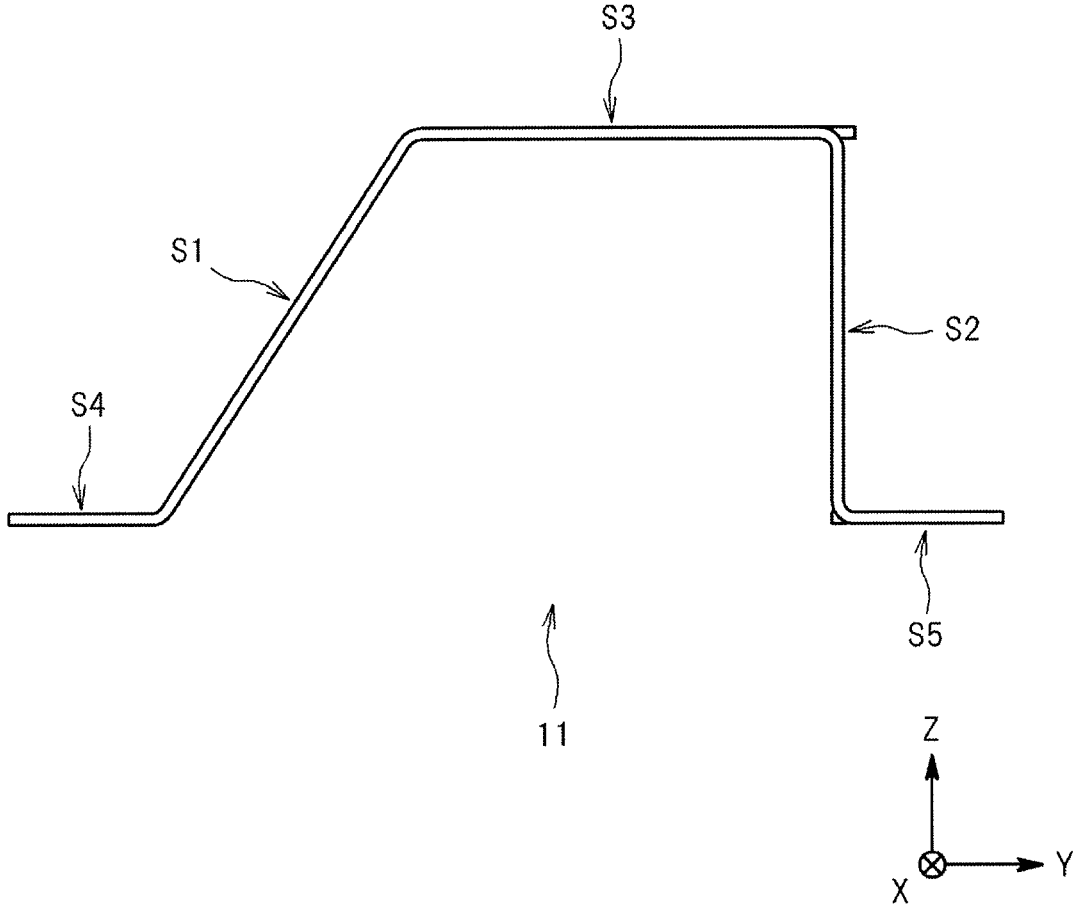
FIG. 6 is a right-side view illustrating a general view of the antenna of the information communication device according to the embodiment of the present invention.
Figure 7:
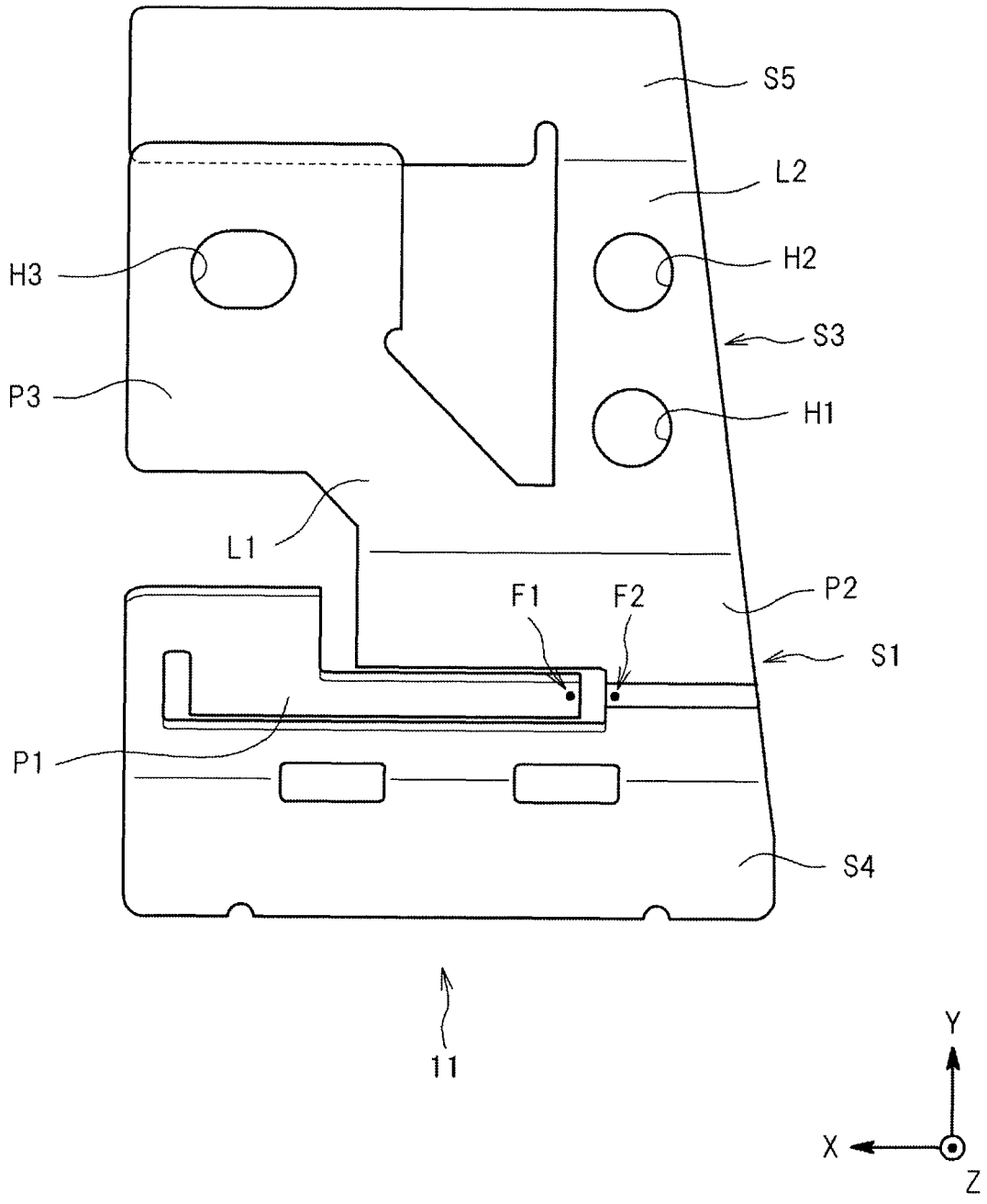
FIG. 7 is a plan view illustrating a general view of the antenna of the information communication device according to the embodiment of the present invention.

FIG. 4 is a perspective view illustrating an outer appearance of the first antenna 11. Further, FIG. 5 is a front view illustrating a state of the first antenna 11 when viewed from the front. FIG. 6 is a side view illustrating a state of the first antenna 11 when viewed from the right side. FIG. 7 is a plan view illustrating a state of the first antenna 11 when viewed from the above. Note that here, in a state in which the first antenna 11 is disposed in the enclosure 10 as illustrated in FIG. 2, the second bottom surface 10*c* side of the enclosure 10 (Y-axis negative direction side) is regarded as the front side of the first antenna 11.

The first antenna 11 includes a radiation plate formed by processing a plate-like metal material. As illustrated in FIG. 6, when viewed from the side, the first antenna 11 has a shape that follows the circumference of a trapezoid obtained by cutting obliquely one of the short-side sides of a horizontally long rectangle, excluding the base of the trapezoid. Specifically, the first antenna 11 includes a slope surface portion S1 that is positioned on the front side of the first antenna 11 and is inclined with respect to the base of the trapezoid, a rear surface portion S2 that is positioned on the rear side of the first antenna 11 and stands perpendicular to the base of the trapezoid, and a top surface portion S3 that connects the slope surface portion S1 and the rear surface portion S2 along the top side of the trapezoid. Further, in directions extending from the base of the trapezoid to the front side and the rear side of the first antenna 11, there are formed a bottom surface portion S4 connected to the slope surface portion S1 and a bottom surface portion S5 connected to the rear surface portion S2, respectively. Here, because the first antenna 11 is disposed in the enclosure 10 as illustrated in FIG. 2, the top surface portion S3 and the bottom surface portions S4 and S5 are parallel to the first bottom surface 10*a* of the enclosure 10, whereas the rear surface portion S2 is parallel to the second bottom surface 10*c* and the second top surface 10*d* of the enclosure 10. On the other hand, the slope surface portion S1 is oblique with respect to each of the first bottom surface 10*a*, the second bottom surface 10*c*, and the second top surface 10*d*, which possibly serve as the surface that faces the floor surface (horizontal surface) when the enclosure 10 is placed. Specifically, an end edge of the slope surface portion S1 is connected to an end edge of the top surface portion S3, which is disposed parallel to the first bottom surface 10*a* of the enclosure 10, on one side (Y-axis negative direction side) so as to form an obtuse angle on the underside thereof (Z-axis negative direction side). Further, the bottom surface portion S4 is connected to an end edge of the slope surface portion S1, which is on the opposite side to the side on which the slope surface portion S1 is connected to the top surface portion S3, so as to form an obtuse angle on the upside thereof (Z-axis positive direction side). Further, the rear surface portion S2 is connected downward to an end edge of the top surface portion S3, which is on the opposite side to the side on which the top surface portion S3 is connected to the slope surface portion S1 (Y-axis positive direction side), so as to be orthogonal to the top surface portion S3. The bottom surface portion S5 is connected to a lower end of the rear surface portion S2 in the Y-axis positive direction so as to be orthogonal to the rear surface portion S2. The slope surface portion S1 is oblique with respect to all the other portions, that is, the rear surface portion S2, the top surface portion S3, and the bottom surface portions S4 and S5. In addition, the slope surface portion S1 is disposed in the enclosure 10 so that the slope surface portion S1 is oblique with respect to the horizontal surface in both cases where the enclosure 10 is placed vertically and where the enclosure 10 is placed horizontally.

In this embodiment, the feeder 21*a* is a coaxial cable, and a feeding point to which the feeder 21*a* is connected is located in the slope surface portion S1 of the first antenna 11. Specifically, a conductive portion P1 and a ground portion P2 are formed in the slope surface portion S1, and an inner conductor and an outer conductor of the feeder 21*a* are connected to a connecting point F1 of the conductive portion P1 and a connecting point F2 of the ground portion P2, respectively. The conductive portion P1 extends from the connecting point F1 in the X-axis direction (that is, direction parallel to the first bottom surface 10*a*, the second bottom surface 10*c*, and the second top surface 10*d* of the enclosure 10), and is further formed so that the conductive portion P1 is bent upward on the left-hand side when viewed from the front. By means of the length and the shape of the conductive portion P1, the frequency of the radio signal to be transmitted/received to/from the first antenna 11 is set to fall within the 2.4 GHz band. Further, the ground portion P2 extends in the Z-axis direction (that is, direction perpendicular to the first bottom surface 10*a* of the enclosure 10) as a whole including the connecting point F2, and is formed so that a width in right-left direction is wider at an upper portion than at a portion where the connecting point F2 is located. More specifically, the ground portion P2 protrudes toward the conductive portion P1 side (that is, X-axis positive direction side) at the upper portion higher than the connecting point F2, and is therefore formed wider at the upper portion than at the portion where the connecting point F2 is located. Further, the lower end of this protruding portion is formed so as to extend parallel to the upper end of the conductive portion P1 with a fixed distance therefrom.

In this embodiment, at a position corresponding to the feeding point, the distribution of current flowing through the first antenna 11 becomes the largest. Therefore, owing to the fact that the slope surface portion S1 including the feeding point is oblique with respect to each of the first bottom surface 10*a*, the second bottom surface 10*c*, and the second top surface 10*d* of the enclosure 10 as described above, the radiation characteristic of the first antenna 11 is such that both the vertically polarized wave and the horizontally polarized wave are radiated in any situations where the enclosure 10 is placed with the first bottom surface 10*a*, the second bottom surface 10*c*, and the second top surface 10*d* facing downward, respectively.

Further, in the top surface portion S3, a rectangular portion P3 having a substantially rectangular shape is formed. The rectangular portion P3 is jointed to the ground portion P2 through an intermediation of a joint portion L1. Similarly to the rectangular portion P3, the joint portion L1 constitutes a part of the top surface portion S3, and extends in an oblique direction toward the front surface 10*e* side of the enclosure 10 from the upper end of the ground portion P2 (that is, extends from the upper end of the ground portion P2 in a direction between the X-axis positive direction and the Y-axis positive direction). Then, a tip end portion of the joint portion L1 is connected to a corner portion of the rectangular portion P3. One side of the rectangular portion P3 forms an end edge of the top surface portion S3 on the X-axis positive direction side (that is, front surface 10*e* side of the enclosure 10). A side opposed to the side on the X-axis positive direction side is positioned substantially along an extended line of an end edge of the ground portion P2 on the X-axis positive direction side in plan view. The rectangular portion P3 serves to strengthen the vertically polarized wave of the radio signal radiated from the first antenna 11 in the case where the enclosure 10 is placed horizontally.

Further, in the top surface portion S3, a part of a joint portion L2 is also formed so as to be opposed to the rectangular portion P3 with a space therefrom. The joint portion L2 is formed of a part of the top surface portion S3 and the rear surface portion S2. Through an intermediation of the joint portion L2, the bottom surface portion S5 is connected to the upper end of the ground portion P2. The bottom surface portion S5 extends from a portion connected to the joint portion L2 toward the X-axis positive direction side (that is, front surface 10*e* side of the enclosure 10). An end edge of the bottom surface portion S5 on the X-axis positive direction side is at substantially the same position as end edges of the bottom surface portion S4, the slope surface portion S1, and the top surface portion S3 on the X-axis positive direction side in plan view. Specifically, the end edges of the bottom surface portion S4, the slope surface portion S1, the top surface portion S3, and the bottom surface portion S5 on the left-hand side when viewed from the front are positioned along substantially the same straight line in plan view. The bottom surface portion S5 serves to strengthen the horizontally polarized wave of the radio signal radiated from the first antenna 11 in the case where the enclosure 10 is placed horizontally.

Figure 8:
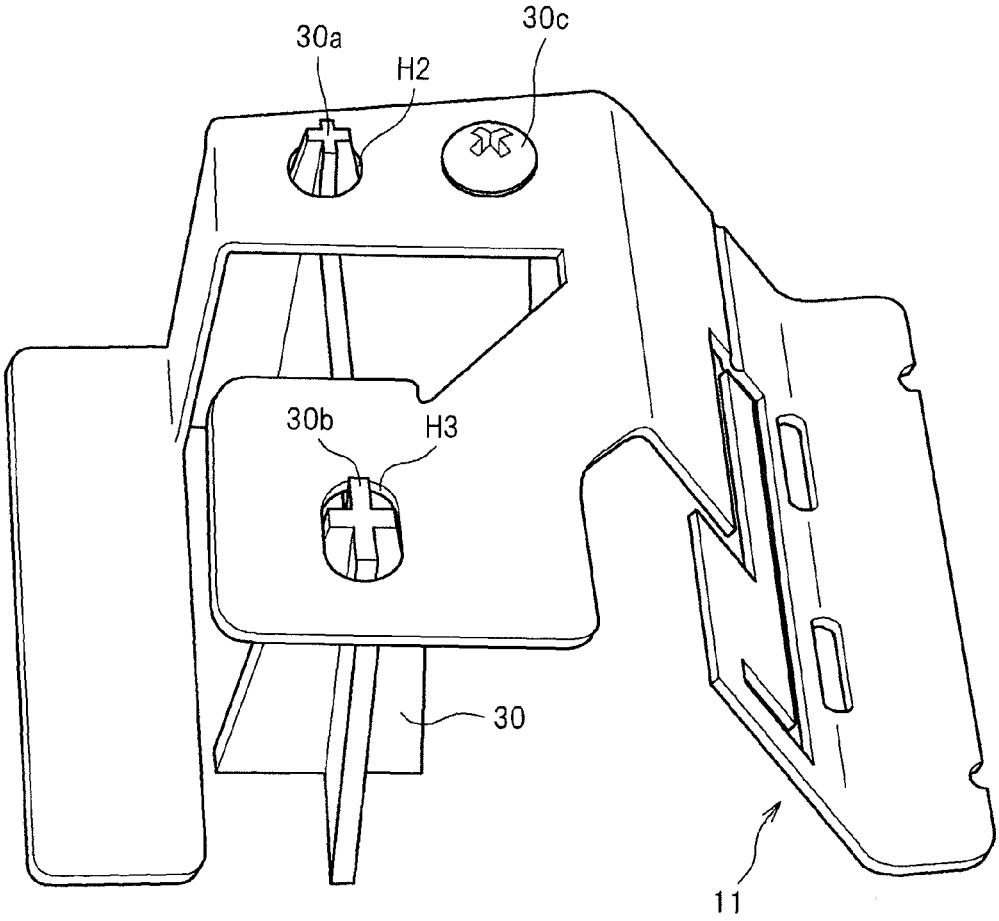
FIG. 8 is an explanatory diagram illustrating a mounting structure of the antenna with respect to the enclosure.

FIG. 8 illustrates a mounting structure of the first antenna 11 with respect to the enclosure 10. As illustrated in FIG. 8, a support body 30 is installed in the enclosure 10, and the first antenna 11 is secured to the support body 30. Specifically, in the joint portion L2 of the first antenna 11, holes H1 and H2 are formed in the portion included in the top surface portion S3. In addition, in the rectangular portion P3 of the top surface portion S3, a hole H3 is formed. The holes H1, H2, and H3 are formed so as to penetrate the top surface portion S3. Meanwhile, a screw hole is formed in the support body 30 at a position corresponding to the hole H1. Further, projecting portions 30*a* and 30*b* for positioning are formed on the support body 30 at positions corresponding to the holes H2 and H3. In a state in which the projecting portions 30*a* and 30*b* are inserted into the holes H2 and H3, respectively, a screw 30*c* is inserted into the hole H1, and is tightened into the screw hole of the support body 30, to thereby secure the first antenna 11 to the enclosure 10. Here, for example, if a configuration in which the bottom surface portions S4 and S5 are secured to the enclosure 10 is employed, there is a fear that, due to mispositioning or the like, the shape of the first antenna 11 may become distorted, resulting in a changed inclination of the slope surface portion S1 with respect to the enclosure 10. In this embodiment, the first antenna 11 is secured to the enclosure 10 only through an intermediation of the top surface portion S3, and hence the above-mentioned distortion of the first antenna 11 may be avoided. Note that the second antenna 12 may employ the same structure to be secured to the enclosure 10.

With the information communication device 1 according to this embodiment, regardless of whether the enclosure 10 is placed vertically or horizontally, and also, regardless of which one of the vertically polarized wave and the horizontally polarized wave a communication target employs as a main polarized wave, it is possible to transmit/receive the radio signal with a practically sufficient strength.

Figure 9:
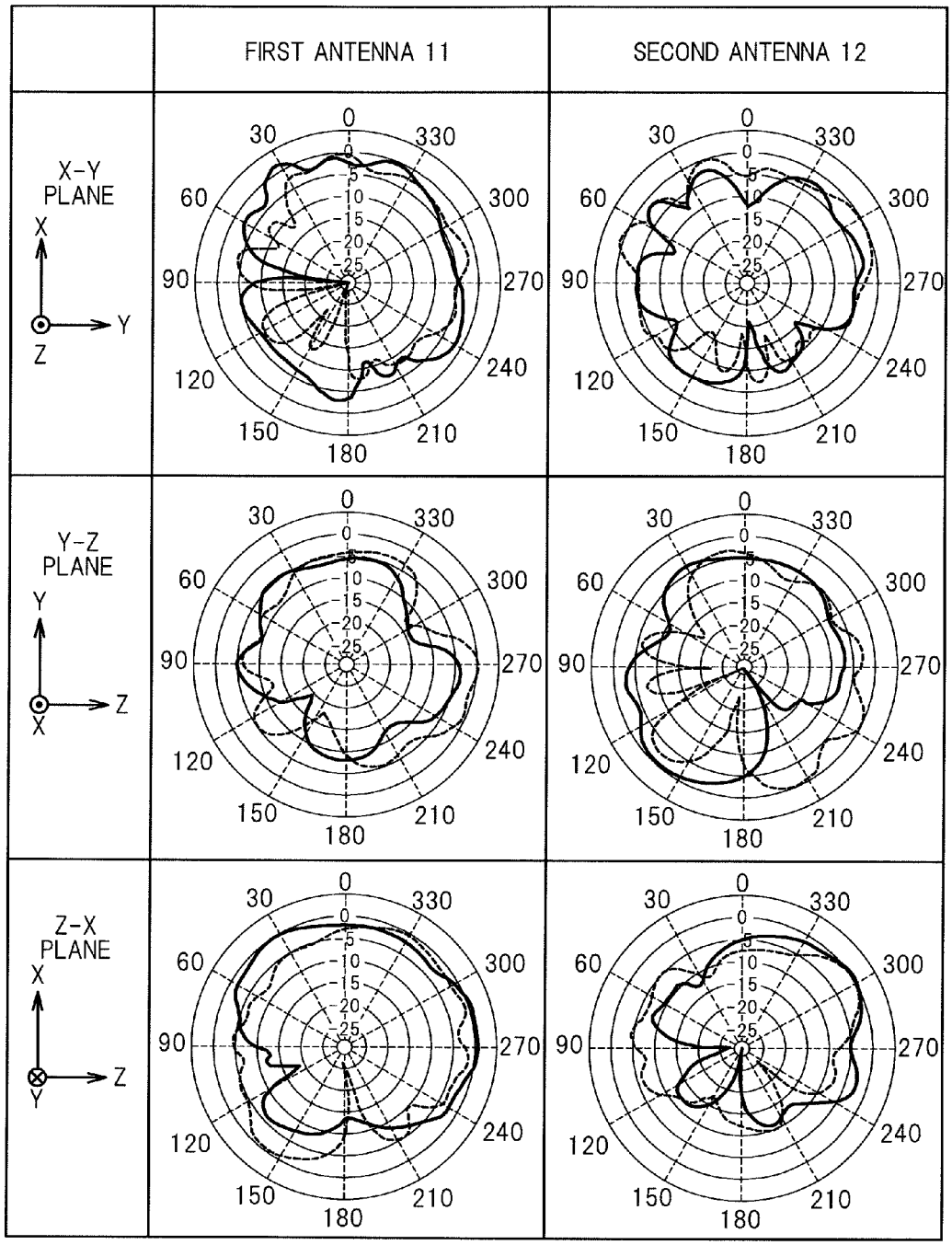
FIG. 9 is an explanatory diagram illustrating an example of radiation patterns of the information communication device according to the embodiment of the present invention.

FIG. 9 illustrates measurement results of respective radiation patterns of the first antenna 11 and the second antenna 12 of the information communication device 1 according to this embodiment. Specifically, with regard to each of three types of attitudes of the enclosure 10, FIG. 9 illustrates gains of a signal in the 2.44 GHz band, which are measured in various directions around the information communication device 1. Specifically, the upper section of FIG. 9 illustrates gains in various directions in the X-Y plane in the case where the enclosure 10 is placed with the first bottom surface 10*a* facing downward (horizontal placement). Note that here, an angle of 0° and an angle of 270° correspond to the X-axis positive direction (front surface 10*e* side) and the Y-axis positive direction (second top surface 10*d* side), respectively. Further, the middle section of FIG. 9 illustrates gains in various directions in the Y-Z plane in a case where the rear surface 10*f* is positioned facing downward. Further, the lower section of FIG. 9 illustrates gains in various directions in the Z-X plane in the case where the enclosure 10 is placed with the second top surface 10*d* facing downward (vertical placement). Further, in each graph, the solid line and the broken line indicate the strengths of the vertically polarized wave and the horizontally polarized wave, respectively.

Figure 10:
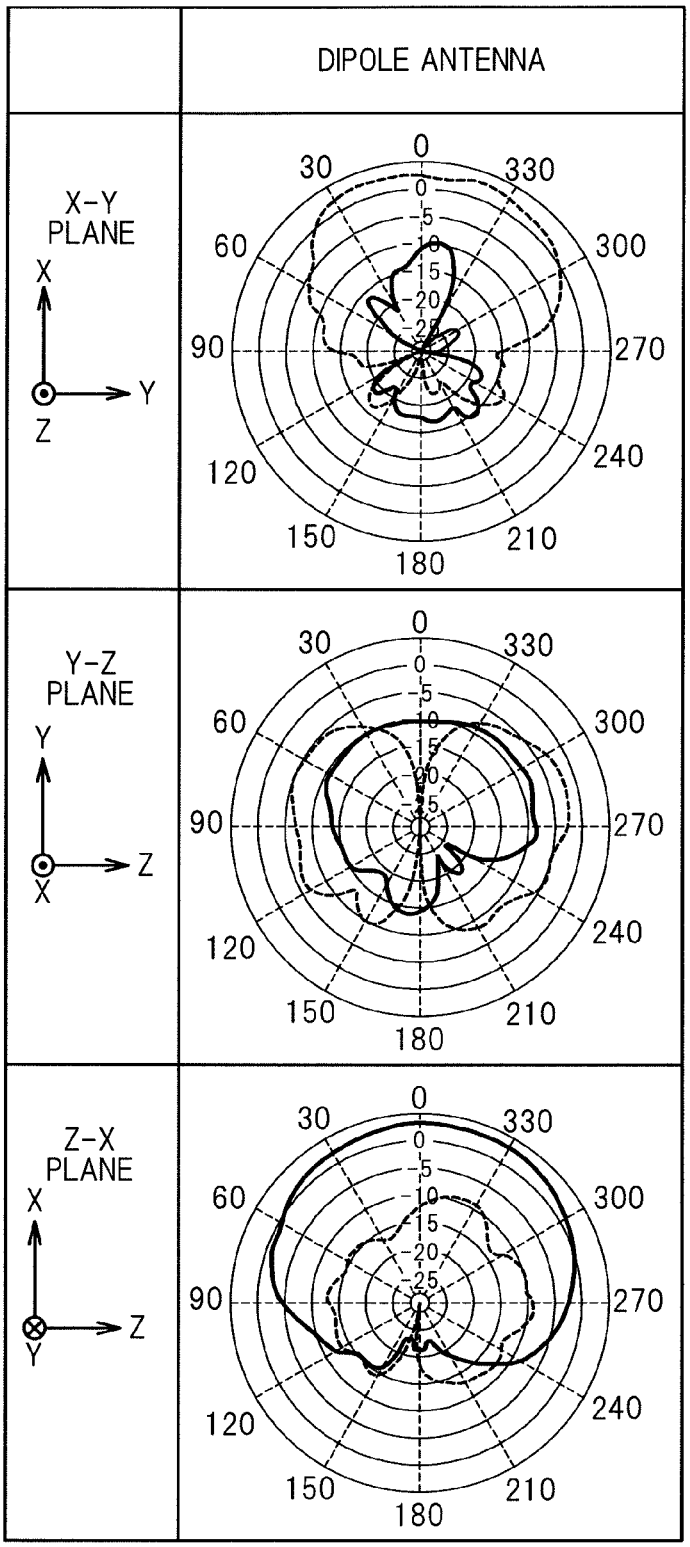
FIG. 10 is an explanatory diagram illustrating an example of radiation patterns of an information communication device using a commonly-used dipole antenna.

On the other hand, FIG. 10 illustrates, as one example for comparison, measurement results of radiation patterns in a case where a commonly-used dipole antenna is disposed in the enclosure 10. Similarly to FIG. 9, FIG. 10 illustrates respective gains of the vertically polarized wave and the horizontally polarized wave with regard to each of the X-Y plane, the Y-Z plane, and the Z-X plane. As illustrated in FIG. 10, in the case of the commonly-used dipole antenna, a graph of the X-Y plane (corresponding to the horizontal placement) shows that only relatively small gains are obtained for the vertically polarized wave, compared to the horizontally polarized wave. On the other hand, in a graph of the Z-X plane (corresponding to the vertical placement), conversely, gains of the horizontally polarized wave are relatively small, compared to the vertically polarized wave.

In contrast, in the case of the first antenna 11 and the second antenna 12 according to this embodiment, both the graph of the X-Y plane and the graph of the Z-X plane show that relatively large gains are obtained for both the vertically polarized wave and the horizontally polarized wave. Note that particularly in the case of the wireless communication based on the Bluetooth standard, the communication target of the information communication device 1 is expected to be a peripheral device (game controller, headset, or the like) located in the vicinity of the user. Accordingly, in both the cases of the vertical placement and the horizontal placement, it is desired that the gain on the front surface 10*e* side (that is, ranges from the angle of 0° to an angle of 90° and from the angle of 270° to an angle of 360°) of the information communication device 1 be relatively larger than the gain on the rear surface 10*f* side (that is, range from the angle of 90° to the angle of 270°). The first antenna 11 is disposed in the enclosure 10 in such a direction that satisfies the above-mentioned condition.

Note that the first antenna 11 and the second antenna 12 need to be installed in the enclosure 10 with at least a given distance between them to avoid interference therebetween. For this case, in the information communication device 1 according to this embodiment, the feeding point is provided on the slope surface portion S1 that is oblique with respect to the first bottom surface 10*a*, and hence interference between the first antenna 11 and the second antenna 12 is less likely to occur. Specifically, for example, at the same positions as illustrated in FIG. 2, the first antenna 11 and the second antenna 12 are disposed so that the slope surface portions S1 of both the first antenna 11 and the second antenna 12 are parallel to the first bottom surface 10*a*, and an isolation characteristic indicating the degree of isolation therebetween is measured to compare with the isolation characteristic obtained from the layout according to this embodiment. As a result, an improved isolation characteristic is observed in the case of the layout according to this embodiment, in which the slope surface portion S1 is oblique with respect to the first bottom surface 10*a*, compared to the case in which the slope surface portion S1 is parallel to the first bottom surface 10*a*. Accordingly, by making the slope surface portion S1 including the feeding point inclined with respect to the first bottom surface 10*a*, the first antenna 11 and the second antenna 12 can be disposed at relatively closer positions for use, compared to the other case in which the slope surface portion S1 is not inclined. Note that here, the first antenna 11 and the second antenna 12 are disposed parallel to each other so that the respective slope surface portions S1 including the feeding points face in the same direction (second bottom surface 10*c* side), but the first antenna 11 may be disposed toward a direction in which the slope surface portion S1 thereof faces the second top surface 10*d* side. In this case, the respective slope surface portions S1 face in opposite directions, and hence the first antenna 11 and the second antenna 12 become less likely to interfere with each other.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An information communication device for performing wireless communication, comprising:

an enclosure having a bottom surface; and an antenna disposed in the enclosure so that at least one surface of a radiation plate is oblique with respect to the bottom surface of the enclosure, the antenna having a feeding point located on the surface that is oblique with respect to the bottom surface of the enclosure, wherein the antenna is fed with power through a coaxial cable, the radiation plate comprises, on the surface that is oblique with respect to the bottom surface, a tip end portion extending in a horizontal direction and a cutout portion surrounding the tip end portion on at least three sides, wherein an inner conductor of the coaxial cable is connected to a connection point located on the tip end portion, wherein an outer conductor of the coaxial cable is connected to a connection point located on the cutout portion, wherein the cutout portion comprises top end edge of the surface that is oblique with respect to the bottom surface of the enclosure, wherein the radiation plate comprises a top surface portion that forms a top surface of the antenna, the top surface portion is jointed to the top end edge so as to make an obtuse angle with the surface that is oblique with respect to the bottom surface of the enclosure, wherein the radiation plate further comprises a bottom surface portion that forms a bottom surface of the antenna, wherein the top surface portion comprises a first polarized wave strengthening portion as a part of the top surface portion, and wherein the bottom surface portion comprises a second polarized wave strengthening portion as a part of the bottom surface portion, the second polarized wave strengthening portion is connected to another part of the top surface portion.

2. The information communication device according to claim 1, wherein:

the enclosure is configured so as to be placed with one of side surfaces of the enclosure, which intersect the bottom surface, being used as a downward surface that faces a floor surface; and the antenna is disposed in the enclosure so that the surface that is oblique with respect to the bottom surface is also oblique with respect to the one of the side surfaces of the enclosure.

3. The information communication device according to claim 1, wherein the radiation plate comprises a portion that constitutes a surface parallel to the bottom surface, and is jointed to a portion constituting the surface that is oblique with respect to the bottom surface.

4. An antenna, comprising, in at least part of a radiation plate:

a surface formed so as to be oblique with respect to a bottom surface portion that forms a bottom surface of the antenna; and a top surface portion that forms a top surface of the antenna, the top surface portion is jointed to the surface that is oblique with respect to the bottom surface portion so as to form an obtuse angle with respect to the surface that is oblique with respect to the bottom surface portion, wherein the surface that is oblique with respect to the bottom surface portion has a feeding point located thereon, the antenna is fed with power through a coaxial cable, the radiation plate comprises, on the surface that is oblique with respect to the bottom surface portion, a tip end portion extending in a horizontal direction and a cutout portion surrounding the tip end portion on at least three sides, wherein an inner conductor of the coaxial cable is connected to a connection point located on the tip end portion, wherein an outer conductor of the coaxial cable is connected to a connection point located on the cutout portion, wherein the cutout portion comprises top end edge of the surface that is oblique with respect to the bottom surface portion, wherein the top surface portion is jointed to the top end edge, wherein the top surface portion comprises a first polarized wave strengthening portion as a part of the top surface portion, and wherein the bottom surface portion comprises a second polarized wave strengthening portion as a part of the bottom surface portion, the second polarized wave strengthening portion is connected to another part of the top surface portion.

* * * * *